US007340202B2

(12) United States Patent
Miyamoto et al.

(10) Patent No.: US 7,340,202 B2
(45) Date of Patent: Mar. 4, 2008

(54) IMAGE FORMING APPARATUS AND PROCESS CARTRIDGE FOR USE THEREWITH

(75) Inventors: Satoru Miyamoto, Kanagawa (JP); Makoto Yasuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 154 days.

(21) Appl. No.: 11/266,320

(22) Filed: Nov. 4, 2005

(65) Prior Publication Data

US 2006/0120767 A1 Jun. 8, 2006

(30) Foreign Application Priority Data

Nov. 11, 2004 (JP) ..... 2004-327816

(51) Int. Cl.
*G03G 15/08* (2006.01)
*G03G 15/09* (2006.01)

(52) U.S. Cl. ..... 399/267; 430/109.3; 430/109.4; 430/110.4; 430/111.35; 430/123.41

(58) Field of Classification Search ..... 399/267, 399/111, 265, 252, 222; 430/109.1, 109.3, 430/109.4, 110.4, 111.1, 111.35, 111.4, 120.1, 430/122.1, 122.2, 123.41, 123.5
See application file for complete search history.

(56) References Cited

U.S. PATENT DOCUMENTS 6,432,590 B1 8/2002 Ueda et al. ..... 430/18
2003/0152403 A1* 8/2003 Suzuki et al. ..... 399/267
2004/0175643 A1* 9/2004 Baba et al. ..... 430/109.4
2006/0024606 A1* 2/2006 Suzuki et al. ..... 430/111.35
2006/0051692 A1* 3/2006 Hasegawa et al. ..... 430/109.3
2006/0067741 A1* 3/2006 Azami ..... 399/267
2006/0068306 A1* 3/2006 Shu et al. ..... 430/45

(Continued)

FOREIGN PATENT DOCUMENTS

JP 7-140723 6/1995

(Continued)

OTHER PUBLICATIONS

U.S. Appl. No. 09/384,797, filed Aug. 27, 1999, Satoru Miyamoto.

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus and process cartridge that achieves extended operating life of a two-component developer without generating such problems as toner scattering, etc. either in the initial period or over time. The gap between the image support member and the developer support member is set to 0.3±0.1 mm. A substance having a resin cover layer on the surface of a core material is used as the carrier. The resin cover layer provides a conductive covering layer having a tin dioxide layer on the surface of base particles and an indium oxide layer, and contains conductive particles formed such that the oil adsorption is 10 to 300 mL/100 g. A substance that provides a bonding resin including a hybrid resin having vinyl polymers and polyester polymers is used as the toner. The amount of hybrid resin contained in relation to the amount of releasing agent is set to the range of 0.5 to 3.

7 Claims, 5 Drawing Sheets

U.S. PATENT DOCUMENTS

2006/0099009 A1 5/2006 Miyamoto et al.
2006/0251451 A1* 11/2006 Ishigami et al. ..... 399/328

FOREIGN PATENT DOCUMENTS

JP 2001-290312 10/2001
JP 2004-212560 7/2004
JP 2005-24592 1/2005
JP 2005-24593 1/2005

OTHER PUBLICATIONS

U.S. Appl. No. 11/608,521, filed Dec. 8, 2006, Satoru et al.

* cited by examiner

IMAGE FORMING APPARATUS AND PROCESS CARTRIDGE FOR USE THEREWITH

BACKGROUND OF THE INVENTION

1. Field of the Invention

The present invention relates to an image forming apparatus using an electronic photographic system such as a copier, printer, facsimile machine, or a combination of these, and more specifically relates to an image forming apparatus and process cartridge using a two-component developer comprising toner and carrier.

2. Description of the Related Art

Image forming apparatuses such as color copiers and color printers that conduct a developing process step using a two-component developer comprising toner and carrier (including developers that also comprise other additives, etc.) have been disclosed in the past such as Japanese Unexamined Patent Application Publication No. 2004-212560. Disclosed in this publication is an image forming apparatus that in addition to using a developing system that prints only the DC developing bias using the two-component developer, also used a small diameter carrier as the carrier in the two-component developer to heighten image quality. This technology has the object of reducing the generation of carrier adhesion, and of reducing generation of image blotching and characters with missing periphery, etc. Specifically, using a small particle size carrier with a weight average particle size of 20 to 60 μm optimizes the static resistance and saturation magnetization of the carrier.

Moreover, disclosed in Japanese Unexamined Patent Application Publication No. H7-140723 is a technology that is an image forming apparatus using a two-component developer having the object of preventing carrier adhesion and stabilizing the amount of static electricity, and comprising carbon black as the resistance adjuster in the carrier.

Nonetheless, the conventional technologies described above have had difficulties both with the operating life of the two-component developer and with preventing toner scattering. That is, from the perspective of conserving raw materials and reducing the running costs, it is important to extend the operating life of the two-component developer (the operating live of the carrier) used in the developing process. Generally, after initially rising and reaching a peak, the charge capacity of the carrier gradually decreases corresponding to passage of agitation time (or number of printed images). Then, when the charge capacity of the carrier falls below a specified amount, the end of the operating life is reached. The amount of charge of the toner (toner charge) also initially increases and gradually decreases over time corresponding to the changes over time of this kind of carrier charge capacity.

Meanwhile, the size of the initial charge capacity of the carrier can be freely set depending on the adjustment of components. Consequently, it is possible to anticipate the changes of carrier charge capacity over time as described above by setting a large initial carrier charge capacity. However, in this case, the toner concentration (the percentage of toner in the developer) is increased by increasing the amount of initial toner charge, and toner scattering is prone to occur. When toner scattering occurs, the interior of the image forming apparatus may become stained, or staining on the output image may also occur.

The technology disclosed in the previously described Japanese Unexamined Patent Application Publication No. 2004-212560 sets small diameter carrier conditions (static resistance, saturation magnetization, etc.) for reducing generation of image blotching and characters with missing periphery, as well as carrier adhesion. However, there is the problem that extended developer operating life has not been fully achieved.

Moreover, the technology disclosed in the previously described Japanese Unexamined Patent Application Publication No. H7-140723 can expect the effect of stabilizing the amount of charge over time because carbon black is comprised in the carrier as a resistance adjuster. However, if about 300,000 pages of printed images are assumed as the operating life, a problem is posed by the concern that the carbon black comprised in the carrier can migrate to the toner over time and promote deterioration of the carrier.

SUMMARY OF THE INVENTION

An object of the present invention is to resolve the problems described above, and to offer an image forming apparatus and process cartridge that achieves a long operating life of a two-component developer without generating such difficulties as toner scattering either initially or over time.

In accordance with an aspect of the present invention, an image forming apparatus comprises an image support member on which an electrostatic latent image is formed; and a developing unit that houses a two-component developer comprising a toner and a carrier, and comprises a developer support member that supports the two-component developer at a position opposing the image support member. The gap between the image support member and the developer support member in the opposing position is 0.3±0.1 mm. The carrier has a resin cover layer on the surface of a core material. The resin cover layer comprises conductive particles provided with a conductive covering layer comprising a tin dioxide layer on the surface of base particles, and an indium oxide layer including tin dioxide provided on the tine dioxide layer. The conductive particles are formed so that the oil adsorption thereof is 10 to 300 mL/100 g. The toner is provided with a bonding resin, releasing agent, and coloring agent. The bonding resin comprises a hybrid resin having a vinyl polymer and a polyester polymer, and is formed such that the amount of the hybrid resin contained in relation to the amount of the releasing agent is in the range of 0.5 to 3.

In accordance with another aspect of the present invention, a process cartridge is provided to be freely attached to and detached from the apparatus main body of an image forming apparatus. An image support member and a processing unit are unified in the cartridge. The image forming apparatus comprises an image support member on which an electrostatic latent image is formed; and a developing unit that houses a two-component developer comprising a toner and a carrier, and comprises a developer support member that supports the two-component developer at apposition opposing the image support member. The gap between the image support member and the developer support member in the opposing position is 0.3±0.1 mm. The carrier has a resin cover layer on the surface of a core material. The resin cover layer comprises conductive particles provided with a conductive covering layer comprising a tin dioxide layer on the surface of base particles, and an indium oxide layer including tin dioxide provided on the tine dioxide layer. The conductive particles are formed so that the oil adsorption thereof is 10 to 300 mL/100 g. The toner is provided with a bonding resin, releasing agent, and coloring agent. The bonding resin comprises a hybrid resin having a vinyl polymer and a polyester polymer, and is formed such that the amount of the hybrid resin contained in relation to the amount of the releasing agent is in the range of 0.5 to 3.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First, the present inventors arrived at knowing the following as a result of repeated research in order to resolve the aforementioned problems of the conventional technologies. Specifically, the operational life of the two-component developer can be extended by using a carrier (carbonless carrier) having a conductive covering layer comprising a tin dioxide layer and an indium oxide layer without containing carbon black, and by uniformly and firmly securing the conductive layer to the particle surface and reducing the drop of charge capacity over time. However, this alone is not sufficient to make the operating life a number of printed images exceeding 300,000, and it is necessary to set the carrier to a large initial charge capacity. Moreover, it is necessary to use a toner that matches this kind of carrier and can withstand the increase of the initial amount of toner charge. Further, with regard to the generation of initial toner splatter, it is necessary to secure a degree of margin in the main body of the image forming apparatus that is not the two-component developer itself.

A first embodiment of the present invention will be explained in detail below by referring to the diagrams.

Further, in this embodiment "process cartridge" is defined as a unit that is unified with at least one among a charge unit that charges an image support member, a developing unit that develops a latent image that is formed on the image support member, a cleaning unit that cleans the surface of the image support member, or an image support unit; and that is configured to freely attach and detach in related to the image forming apparatus main body.

In addition, the same codes used in the present embodiment will be given to the same or equivalent parts in the various diagrams, and redundant explanations will be suitably simplified or omitted.

First, the overall configuration and operation of an image forming apparatus related to the present embodiment will be explained using FIG. 1.

Figure 1:
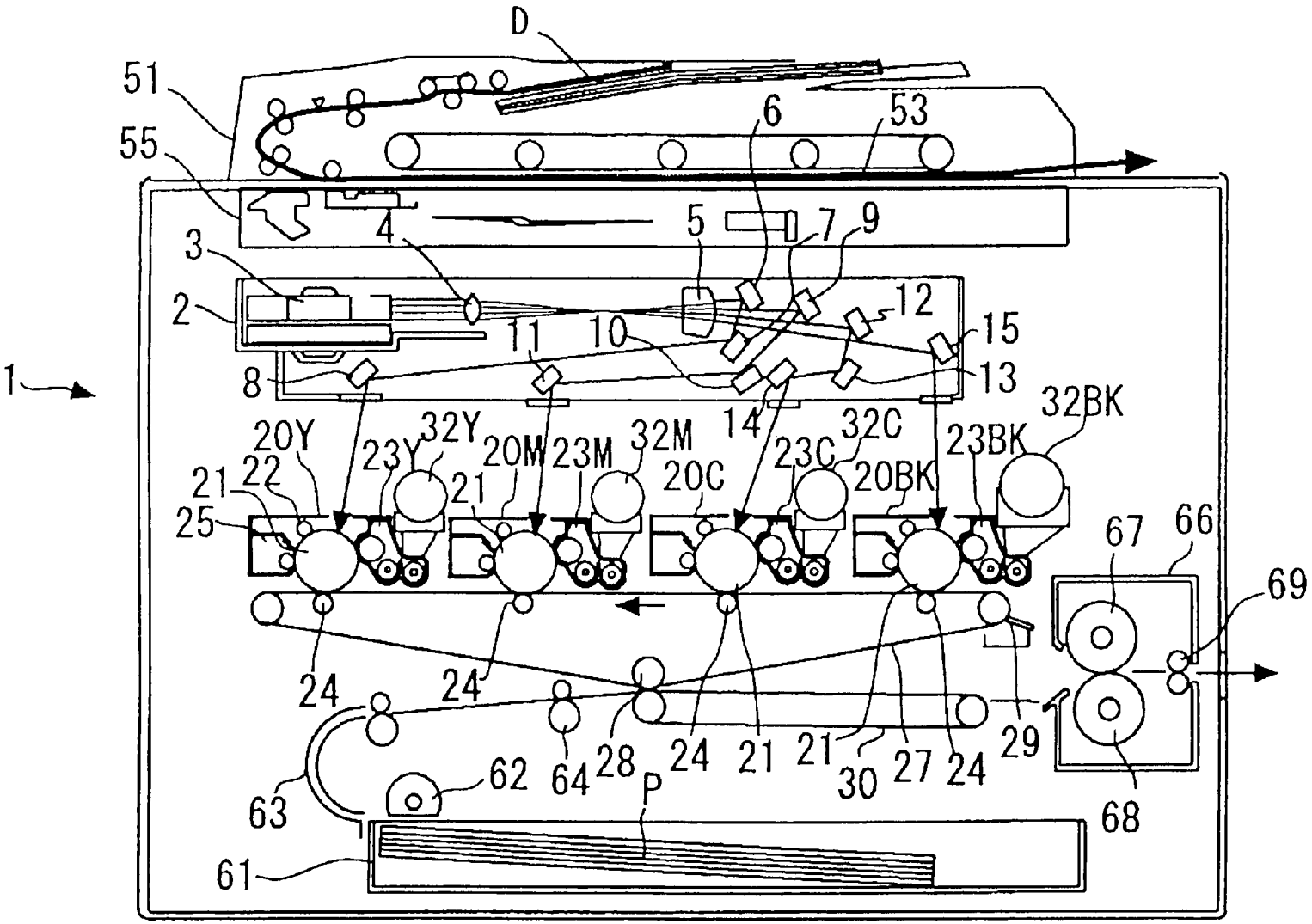
FIG. 1 is an overall block drawing of an image forming apparatus of a first embodiment of the present invention.

In FIG. 1, 1 indicates the apparatus main body of a color copier as the image forming apparatus; 2 indicates the write unit (exposure unit) that emits laser light based on the input image data; 20Y, 20M, 20C, and 20BK indicate process cartridges corresponding to various colors (yellow, magenta, cyan, and black); 21 indicates photosensitive drums as image support members housed respectively in the process cartridges 20Y, 20M, 20C, and 20BK; 22 indicates a charge unit that charges the surface of the photosensitive drum 21; 23Y, 23M, 23C, and 23 BK indicate developing units that develop the electrostatic latent image formed on the photosensitive drum 21; 24 indicates a transfer bias roller that transfers a toner image formed on the photosensitive drum 21 to intermediate transfer belt 27; and 25 indicates a cleaning unit that recovers untransferred toner on the photosensitive drum 21.

In addition, 27 indicates an intermediate transfer belt that laminates and transfers multiple color toner images; 28 indicates a second transfer bias roller that transfers onto the recording medium P the toner image formed on the intermediate transfer belt 27; 29 indicates an intermediate transfer belt cleaning unit that recovers untransferred toner on the intermediate transfer belt 27; 30 indicates a transport belt that transports the recording medium P onto which the four color toner images have been transferred; 32Y, 32M, 32C, and 32BK indicate toner supply units that supply the toners of various colors to the developing units 23Y, 23M, 23C, and 23 BK; 51 indicates a document transport unit that transports a document D to the document reading unit 55; 55 indicates a document reading unit (scanner) that reads the image data of the document D; 61 indicates a paper feeder that stores recording medium P such as transfer paper, etc.; and 66 indicates a fixing unit that fixes the unfixed image onto the recording medium P.

Here, the photosensitive drums 21, the charge units 22, and the cleaning units 25 are unified respectively with the process cartridges 20Y, 20M, 20C, and 20BK. Then, the process cartridges 20Y, 20M, 20C, and 20BK are replaced in relation to the apparatus main body 1 in a specified replacement cycle. In the same way, the developing units 23Y, 23M, 23C, and 23BK are also replaced in relation to the apparatus main body 1 in a specified replacement cycle based on the operating life of the developer.

Image formation of various colors (yellow, magenta, cyan, and black) takes place on the photosensitive drums 21 of the process cartridges 20Y, 20M, 20C, and 20BK respectively.

The operation of the image forming apparatus during normal color image formation will be explained below.

First, the document D is transported from the document tray by the transport roller of the document transport unit 51 in the direction of the arrow in the diagram, and is mounted on a contact glass 53 of the document reading unit 55. Then, the image data of the document D mounted on the contact glass 53 is optically read by the document reading unit 55.

In more detail, the document reading unit 55 scans the image of the document D on the contact glass 53 while irradiating light emitted from an illumination lamp. Then, the light reflected by the document D forms an image on color sensors through a mirror group and a lens. After having been read for each RGB (red, green, blue) color-resolved light by the color sensors, the color image data of document D is converted to electronic image signals. Further, based on the RGB color-resolved image signals, such processing as color conversion processing, color compensation processing, and spatial frequency compensation process is conducted by an image processing unit (not indicated in the diagram), and yellow, magenta, cyan, and black color image data are obtained.

Then, the yellow, magenta, cyan, and black color image data is transmitted to the write unit 2. Laser light (exposure light) based on the image data of the various colors is emitted from the write unit 2 onto the corresponding photosensitive drums 21 of the process color cartridges 20Y, 20M, 20C, and 20BK.

Meanwhile, the four photosensitive drums 21 rotate respectively in the clockwise direction in FIG. 1. Then, first, the surfaces of the photosensitive drum 21 are uniformly charged at the position opposing the charge units 22 (charge process). In this way, charge potential is formed on the photosensitive drums 21. Afterwards, the surfaces of the charged photosensitive drums 21 reach the respective laser light irradiation positions.

In the write unit 2, laser light corresponding to the image signals is irradiated from the light source according to each color. After falling on and being reflected by the polygon mirror 3, the laser light passes through lenses 4 and 5. After passing through lenses 4 and 5, the laser light passes through separate light routes for each color component of yellow, magenta, cyan, and black (exposure process).

After being reflected by mirrors 6 to 8, the laser light corresponding to the yellow component irradiates the surface of the photosensitive drum 21 of the first process cartridge 20Y from the left side of the paper surface. At this time, the laser light of the yellow component is scanned in the direction of the rotating spindle of the photosensitive drum 21 (main scan direction) by the polygon mirror 3 that rotates at high speed. In this way, an electrostatic latent image corresponding to the yellow component is formed on the photosensitive drum 21 after having been charged by the charge unit 22.

In the same way, after being reflected by mirrors 9 to 11, the laser light corresponding to the magenta component irradiates the surface of the photosensitive drum 21 of the second process cartridge 20M from the left side of the paper surface. After being reflected by mirrors 12 to 14, the laser light corresponding to the cyan component irradiates the surface of the photosensitive drum 21 of the third process cartridge 20C from the left side of the paper surface. After being reflected by mirror 15, the laser light corresponding to the black component irradiates the surface of the photosensitive drum 21 of the fourth process cartridge 20BK from the left side of the paper surface.

Subsequently, the surfaces of the photosensitive drums 21 on which the electrostatic latent images of the various colors have been formed reach the positions opposing the developing units 23Y, 23M, 23C, and 23BK respectively. Then, the toners of the various colors are supplied from the various developing units 23Y, 23M, 23C, and 23BK onto the photosensitive drums 21, and the latent images on the photosensitive drums 21 are developed (development process).

Next, the surfaces of the photosensitive drums 21 after development processing pass through positions opposing photosensors 41 respectively (refer to FIG. 2), and then arrive at positions opposing the intermediate transfer belt 27. Here, the transfer bias rollers 24 are arranged at respectively opposing positions so as to contact the inner peripheral surface of the intermediate transfer belt 27. Then, at the position of the transfer bias rollers 24, the images of the various colors formed on the photosensitive drums 21 are laminated and transferred in order onto the intermediate transfer belt 27 (first transfer process).

Then, the surfaces of the photosensitive drums 21 after the first transfer process arrive at the position opposing the respective cleaning units 25. The cleaning units 25 recover the untransferred toner remaining on the photosensitive drums 21 (cleaning process).

Subsequently the surfaces of the photosensitive drums 21 pass through a charge removal unit not indicated in the diagrams, and the series of image forming processes of the photosensitive drums 21 is completed.

Meanwhile the surface of the intermediate transfer belt 27, onto which the various colored images on the photosensitive drums 21 have been transferred, runs in the direction of the arrow indicated in the diagram, and arrives at the position of the second transfer bias roller 28. Then, at the position of the second transfer bias roller 28, the full color image on the intermediate transfer belt 27 undergoes a second transfer onto the recording medium P (second transfer process).

Next, the surface of the intermediate transfer belt 27 arrives at the position of the intermediate transfer belt cleaning unit 29. The intermediate transfer belt cleaning unit 29 recovers the untransferred toner on the surface of the intermediate transfer belt 27, and the series of transfer processes on the intermediate transfer belt 27 is completed.

Here, the recording medium P at the position of the second transfer bias roller 28 is transported from a feeder 61 via a transport guide 63 and a resist roller 64, etc. In more detail, after passing through the transport guide 63, the transfer paper P fed by a paper feed roller 62 from the feeder 61 that houses the recording medium P is led to the resist roller 64. Timed to match the toner image on the intermediate transfer belt 27, the recording medium P that has reached the resist roller 64 is transported toward the position of the second transfer bias roller 28.

Next, the recording medium P onto which the full color image has been transferred is led to the fixing unit 66 by the transfer belt 30. At the fixing unit 66, the color mage is fixed onto the recording medium P by the nip between a heat roller 67 and a pressure roller 68. Then, the recording medium P after fixing processing is discharged by a paper discharge roller 69 to outside of the apparatus main body 1 as an output image.

Figure 2:
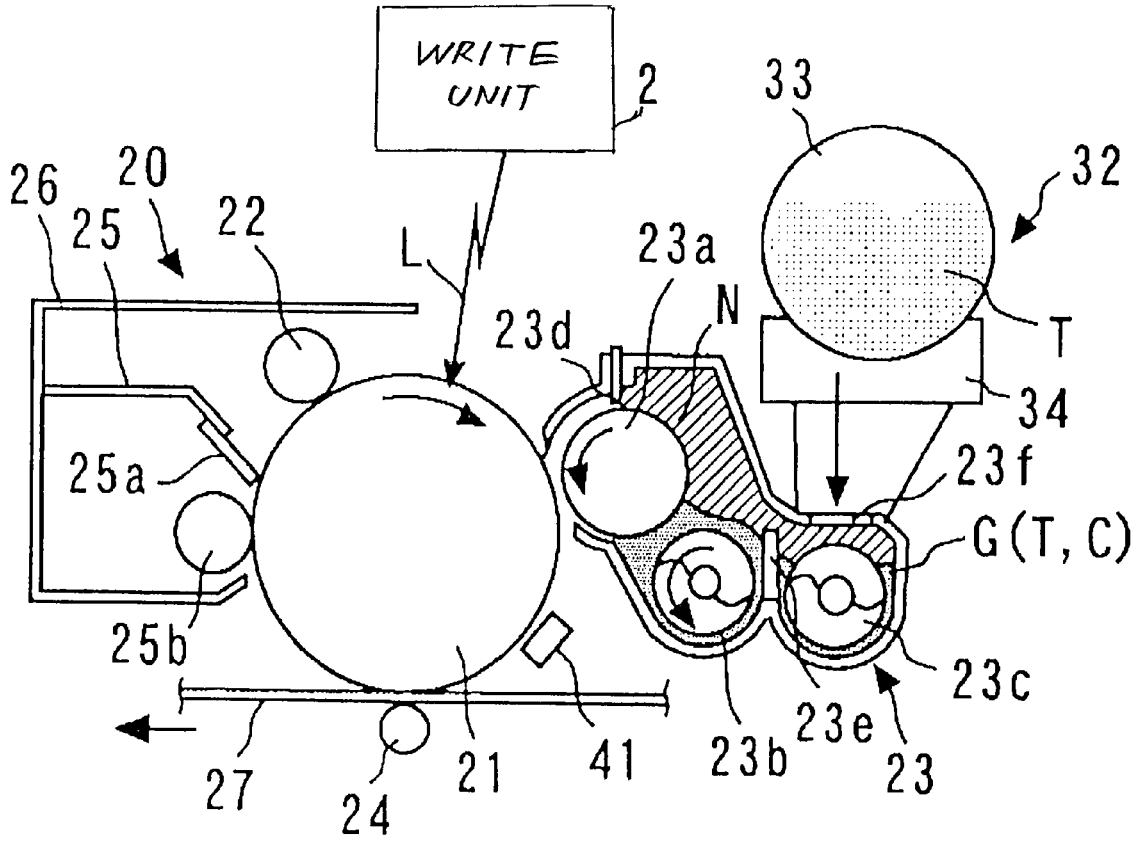
FIG. 2 is a cross-sectional drawing indicating the configuration of the image forming unit of the same image forming apparatus.
Figure 3:
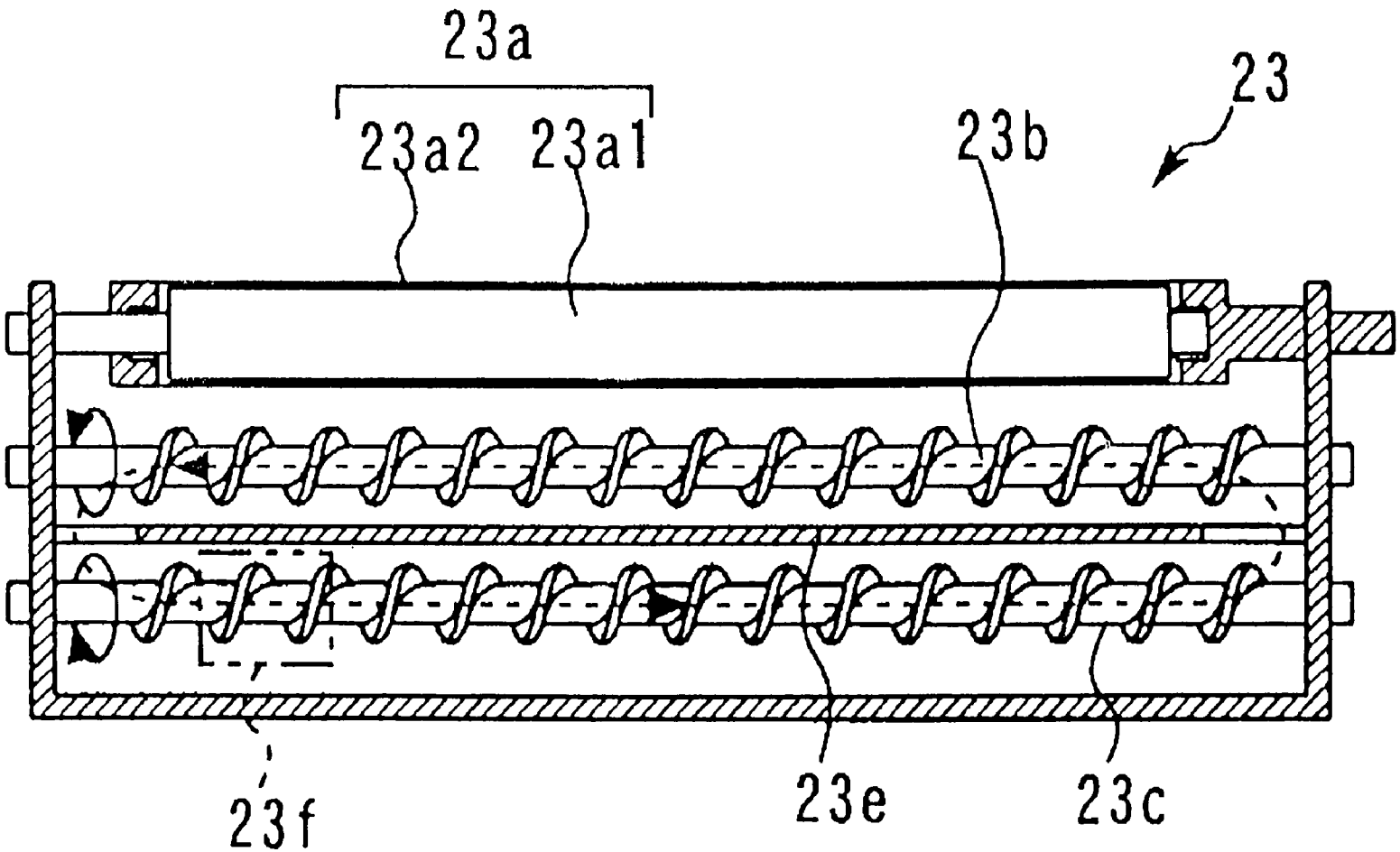
FIG. 3 is a cross-sectional diagram indicating the configuration of the developing unit of the same image forming apparatus.

Next, the image forming unit of the image forming apparatus will be described in detail using FIG. 2 and FIG. 3. FIG. 2 is a cross-sectional diagram indicating an image forming unit; and FIG. 3 is a cross-sectional diagram of the longitudinal direction (perpendicular to the paper surface of FIG. 2) indicating the developing unit thereof.

Further, the four image forming units arranged in the apparatus main body 1 have nearly the same structures except for the color of the toner T used in the image forming process, and therefore the alphabetic codes (Y, M, C, BK) have been omitted from the process cartridge, developing unit, and toner supply unit in the diagrams.

As indicated in FIG. 2, in the process cartridge 20, the photosensitive drum 21 as the image support member, the charge unit 22, and the cleaning unit 25 are mainly housed as a single unit in a case 26. The cleaning blade 25*a* and the cleaning roller 25*b* that contact the photosensitive drum 21 are arranged in the cleaning unit 25.

The developing unit 23 is mainly configured by a developing roller 23*a* as the developer support member opposing the photosensitive drum 21, a first transport screw 23*b* opposing the developing roller 23*a*, a second transport screw 23*c* opposing the first transport screw 23*b* with an intervening barrier member 23*e*, and a doctor blade 23*d* opposing the developing roller 23*a*. Referring to FIG. 3, the developing roller 23*a* is configured by a magnet 23*a*1 that is secured to the interior and forms a magnetic pole on the roller peripheral surface, and a sleeve 23a2 that rotates around the perimeter of the magnet 23a1. The sleeve 23a2 has an exterior diameter of 25 mm, a width of 328 mm, and, on the outer peripheral surface, V-shaped grooves are formed circumferentially, etc. at a pitch interval. Seven magnetic poles are formed on the developing roller 23a by the magnet 23a1. The main pole of the seven magnetic poles is formed in the developing region; the main pole angle is 3 degrees, the peak magnetic force is 120 mT, and the half value width is 23 degrees. Of the seven magnetic poles, the scooping magnetic pole for scooping the developer G up onto the developing roller 23a is formed such that the amount scooped is 35±7.5 mg/cm$^2$.

The gap (developing gap) between the developing roller 23a and photosensitive drum 21 in the developing region (opposing position) is set to 0.3±0.1 mm. The gap (doctor gap) between the developing roller 23a and the doctor blade 23d is set to 0.3±0.04 mm. The doctor blade 23d is formed by a magnetic material, and is arranged above a magnetic pole (P6 magnetic pole) having a peak magnetism formed on the developing roller 23a of 60 mT. The first transport screw 23b and the second transport screw 23c comprise 18 mm screws with a 25 mm pitch formed on a core spindle with a diameter of 8 mm.

Further, in addition to the use of the carrier and toner described later, the range of the developing gap described above is an important characteristic value for reducing toner scattering. In order to improve the developing capacity and keep the toner concentration low, making the developing gap 0.4 mm or less reduces toner scattering, decreases the toner spent, and suppresses a drop in the amount of toner charge. Moreover, making the developing gap 0.2 mm or more suppresses the increase of pressure acting on the toner, and can reliably prevent toner adhesion on the sleeve 23a2.

The two-component developer G comprising carrier C and toner T is housed in the space N in the developing unit 23. The carrier C in the developer G has resin coating layers on the surface of a core material. Contained in the layers of the resin cover layers of the carrier are conductive particles, which establish conductive covering layers of a tin dioxide layer on the surface of the base particle, and of an indium oxide layer containing tin dioxide provided on the tin dioxide layer. The conductive particles contained in the resin cover layers are formed such that the oil adsorption is 10 to 300 mL/100 g.

Further, the oil adsorption of the conductive particles can be measured following "21 Oil Adsorption" in JIS-K5101 "Pigment Test Methods".

At least one type of pigment from among aluminum oxide, titanium dioxide, zinc oxide, silicon dioxide, barium sulfide, and zirconium oxide can be used as the base particle of the conductive particles. The powder specific resistance of the conductive particles is formed to be 200 Ω·cm or less. In addition to the conductive particles, non-conductive particles are contained in the layers of the resin cover layers. Then, the volume resistivity of the carrier C is formed in the range of 10 to 16 Log (Ω·cm).

As described above, a tin dioxide layer and an indium oxide layer containing tin dioxide are formed in order on the surface of the base particles of the carrier C of the present embodiment, and therefore, a conductive layer is uniformly and firmly fixed on the particle surface.

Moreover, the conductive particles contained in the resin cover layer are formed such that the oil adsorption is 10 to 300 mL/100 g. Here, if the oil adsorption is less than 10 mL/100 g, then the resistance of the carrier can no longer be adjusted over the long term because the compatibility with the cover resin is insufficient, the density drops, and the dispersion characteristics also drop. If the oil adsorption exceeds 300 mL/100 g, then the resistance can no longer be sufficiently adjusted because the density of the bonding resin is excessively strong, and the surface of the conductive particle surface is completely covered.

A carrier configured in this way can stably adjust the resistance over time without containing carbon black as the resistance adjusting agent; carrier adhesion, etc. can be prevented; and the amount of toner charge can be kept stable over time. The effects of using the carrier of the present embodiment will be explained in detail later.

In addition, the carrier C in the developer G of the present embodiment is formed such that the weight average particle size is 35 μm. Further, a weight average particle size in the range of 20 to 65 μm is preferable.

If the weight average particle size of the carrier is smaller than 20 μm, the carrier will easily adhere because the magnetic force used per particle of carrier becomes too small. In contrast, if the particle size of the carrier is larger than 65 μm, the granularity of the output image falls because it becomes difficult for the toner to faithfully adhere to the latent image to which the toner should adhere.

The toner T of the present embodiment is formed such that the average particle size is 6.8 μm.

In addition, the average particle size of the toner T is preferably formed in the range of 3.5 to 7.5 μm. If the average particle size of the toner is smaller than 3.5 μm, back edge whiting and halo images are prone to occur because the amount of toner adhering to the toner image is reduced. In contrast, if the average particle size of the toner is larger than 7.5 μm, the granularity of the output image falls because it becomes difficult for the toner to faithfully adhere to the latent image to which the toner should adhere.

Moreover, the toner T of the present embodiment is mainly configured by a bonding resin, a releasing agent and a colorant. The bonding resin of the toner T comprises a hybrid resin having a vinyl polymer and a polyester polymer. Moreover, the toner is formed such that the amount of hybrid resin contained in relation to the amount of releasing agent contained is in the range of 0.5 to 3.

The hybrid resin uses a mixture containing a raw material monomer of a condensation polymerized resin, and a raw material monomer of an addition polymerized resin; and the condensation polymerization reaction and the addition polymerization reaction can be simultaneously or separately conducted in the same reaction vessel. Carnauba wax, montan wax or rice waxes of the oxides thereof can be used for the releasing agent, and a content of 3.5 to 10 weight % is preferable.

Toner T configured in this way is highly durable, and provides output images which have high image quality with no uneven luster, and which have no problems such as toner coagulation or adhesion offset, etc.

Moreover, this toner satisfactorily matches with the previously described carrier C, and to a certain extent, can suppress the increase of the amount of initial toner charge (Q/M). Further, the effects based on using the toner of the present embodiment will be explained in more detail later.

The image forming process mentioned earlier will be described in further detail centering on the developing process.

The rotational frequency of the developing roller 23a is 430.9 rpm, and the roller rotates in the direction of the arrow in FIG. 2 such that the linear velocity ratio in relation to the photosensitive drum 21 in the developing region is 2. As indicated in FIG. 3, the developer G within the developing unit 23 circulates longitudinally (circulation in the direction of the broken line arrow in FIG. 3) while being agitated and mixed with toner supplied from the toner supply unit 32 via supply opening 23*f* based on the rotation (rotational velocity 521.6 rpm) in the direction of the arrow of the first transport screw 23*b* and the second transport screw 23*c* arranged with the barrier member 23*e* in between. Then, the toner T adsorbed to the carrier C by friction charging is supported on the developing roller 23*a* together with the carrier C.

The developer G supported on the developing roller 23*a* next arrives at the position of the doctor blade 23*d*. Then, the developer G on the developing roller 23*a* is adjusted to a suitable amount at the position of the doctor blade 23*d*, and afterwards reaches the position opposing the photosensitive drum 21 (developing region).

Subsequently, in the developing region, the toner T in the developer G adheres to the electrostatic latent image formed on the surface of the photosensitive drum 21. Specifically, the toner T adheres to the latent image based on the electric field formed by the potential difference (developing potential) of the potential of the latent image (exposure potential) of the image unit irradiated with laser light L and the developing bias applied to the developing roller 23*a*.

Next, nearly all of the toner T adhering to the photosensitive drum 21 in the developing process is transferred onto the intermediate transfer belt 27. Then, The untransferred toner T remaining of the photosensitive drum 21 is recovered into the cleaning unit 25 by the cleaning blade 25*a* and the cleaning roller 25*b*.

Further, no AC component developing bias is applied, and only a DC component developing bias is applied as the developing bias applied to the developing roller 23*a*. The configuration and control of the power source unit that supplies the developing bias is comparatively simplified thereby. Further, the generation of image blotching by carrier with low resistance can be reduced by applying a DC component developing bias to the developing roller 23*a*.

Here, the toner supply unit 32 provided on the apparatus main body 1 is configured by a toner bottle 33 that is configured to be freely replaced, and a toner hopper unit 34 that supports and rotationally drives the toner bottle 33 and supplies fresh toner T to the developing unit 23. Moreover, toner T (any of yellow, magenta, cyan or black) is housed in the toner bottle 33. In addition, a spiral protuberance is formed on the inner peripheral surface of the toner bottle 33.

Further, the toner T within the toner bottle 33 is suitably supplied into the developing unit 23 from the supply opening 23*f* as the toner T in the developing unit 23 is consumed. The consumption of toner T in the developing unit 23 is directly or indirectly detected by a reflective photosensor 41 opposing the photosensitive drum 21, and a magnetic sensor (not indicated in the diagram) set up in the developing unit 23. In addition, the supply opening 23*f* is provided above the second transport screw 23*c* at one longitudinal (left to right in FIG. 3) end of the second transport screw 23*c*.

Here, in the present embodiment, the toner concentration (TC) is controlled to fall in the range of 6 to 12 weight %. Concretely, the toner is supplied from the toner supply unit 32 to the developing unit 23 such that the detection results of the previously described magnetic sensor and reflective photosensor 41 become an output value corresponding to the previously described range of toner concentration (percentage of toner T in developer G).

The advance of spent toner conditions can be reduced and the fall of toner charge can be diminished by controlling the toner concentration to 12 weight % or less. Moreover, the decrease of image concentration of the output image can be stopped by controlling the toner concentration to 6 weight % or more.

Further, the toner T and carrier C in the present embodiment are formed such that the toner charge is in the range of 25 to 33 μC/g in room temperature and humidity even if the toner concentration is controlled to 10 weight % or more. The extended operational life of the developer G is achieved thereby. Moreover, the generation of sticky carrier adhesion (firefly images) caused by large development potential can be reduced by making the toner charge 33 μC/g or less. Further, the generation of toner scattering and background soiling can be reduced by making the toner change 25 μC/g or more.

Here, the increase of charge when the developer G formed as described above has been air agitated within the developing unit 23 occurs as follows. From the initial toner concentration of 7.996% and toner charge of 31.66 μC/g, after agitated 10 hours, the conditions shift to a toner concentration of 7.175% and toner charge of 68.23 μC/g.

Figure 4:
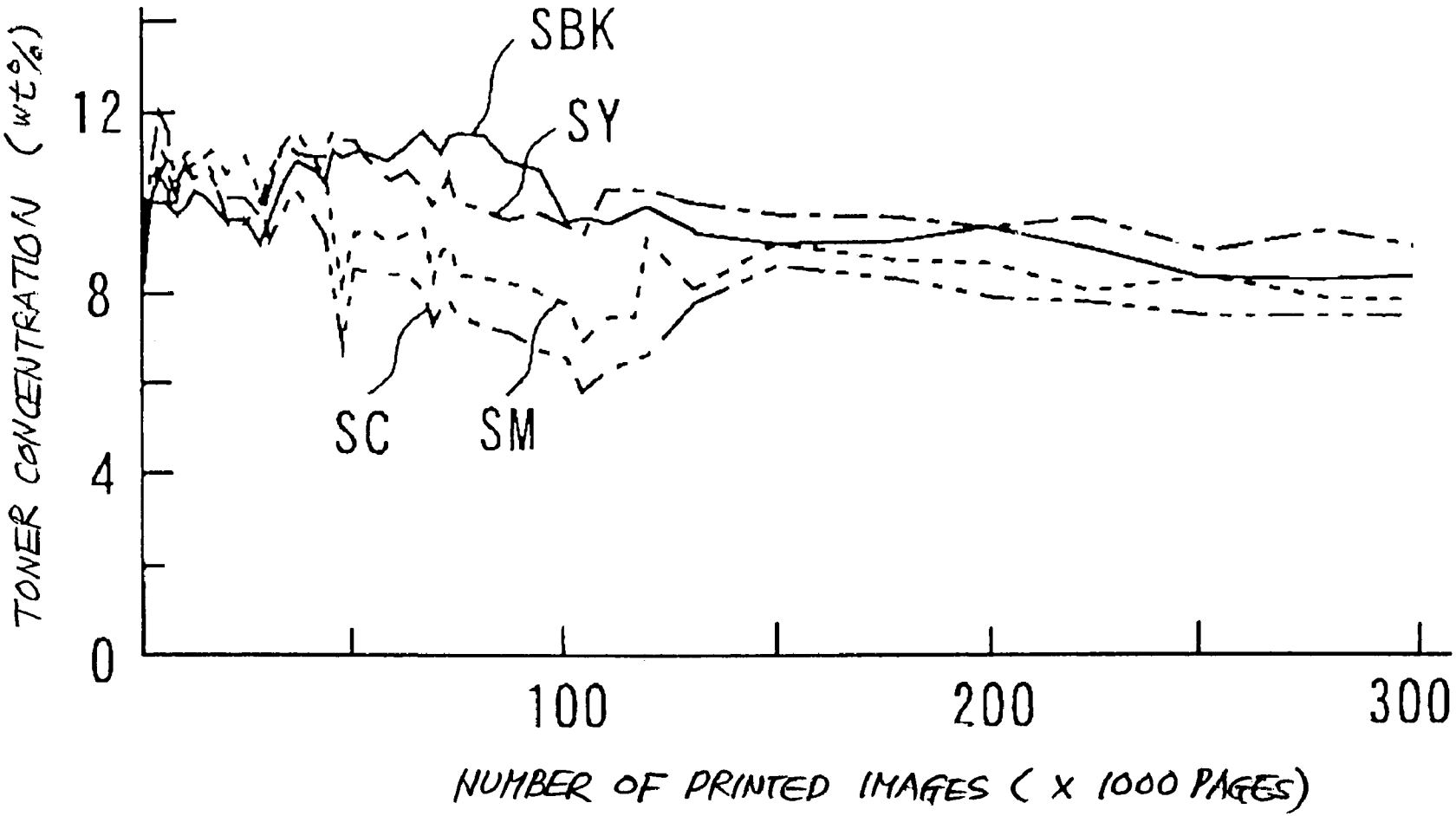
FIG. 4 is a graph indicating the relationship between the number of pages of images printed and the toner concentration.
Figure 5:
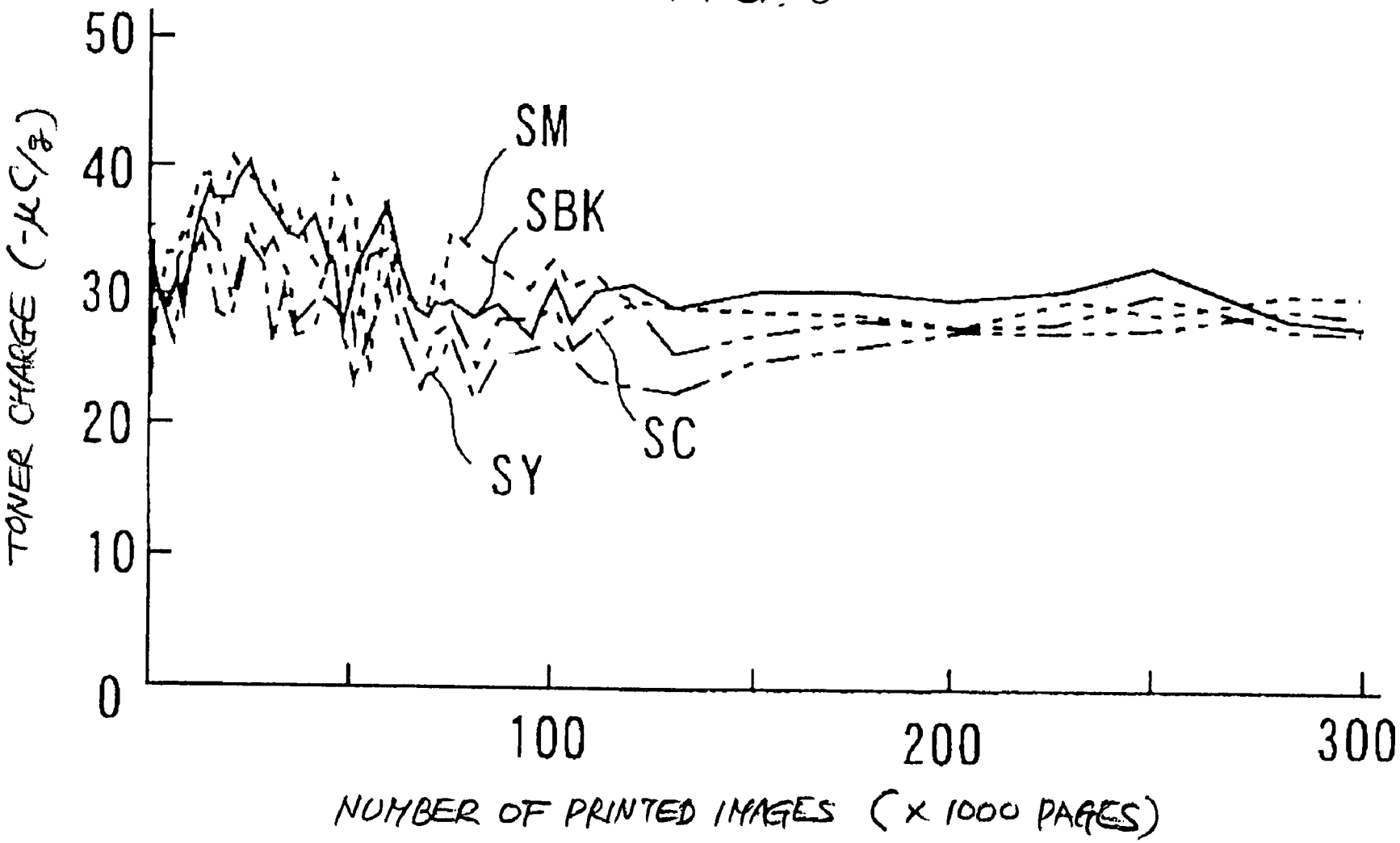
FIG. 5 is a graph indicating the relationship between the number of pages of images printed and the amount of toner charge.

FIGS. 4 and 5 are experimental results indicating the changes of toner concentration and toner charge when conducting a long-term running test using the image forming apparatus of the present embodiment. Further, the status of the generation of toner scattering was visually confirmed during the running test.

Here, the image area percentage of the output image was set to 15%, and the running test was intermittently operated so that the number of printed images per job was 200 pages.

In FIG. 4 the horizontal axis indicates the number of printed images (frequency of image formation), and the vertical axis indicates the toner concentration (TC). In FIG. 5 the horizontal axis indicates the number of printed images (frequency of image formation), and the vertical axis indicates the toner charge (Q/M).

In FIGS. 4 and 5, the solid line SBK indicates the changes of toner concentration and toner charge in the developing unit 23BK for black; the broken line SM indicates the changes of toner concentration and toner charge in the developing unit 23M for magenta; the dotted line SY indicates the changes of toner concentration and toner charge in the developing unit 23Y for yellow; and the double dotted line SC indicates the changes of toner concentration and toner charge in the developing unit 23C for cyan.

Moreover, the static resistance of the carrier for black and for magenta was $10^{11.8}$ Ω·cm; the static resistance of the carrier for cyan was $10^{12.5}$ Ω·cm; and the static resistance of the carrier for yellow was $10^{14}$ Ω·cm. Further, after placing parallel resistance measurement electrodes in the carrier and applying a voltage of 1000 V, the resistance value measured after a fixed time had lapsed was converted to the volume resistivity.

As indicated in FIGS. 4 and 5, the toner charge across the time lapsed from the initial period changed in a comparatively stable manner, and a high toner charge was maintained even when the number of printed images reached 300,000. Moreover, the toner concentration that was controlled in the range of 6 to 12 weight % reached the vicinity of the upper limit in the initial period, but was able to suppress the increase of toner to a certain extent.

In addition, the toner scattering that was visually observed was extremely minimal initially and over time (up until the number of printed images reached 300,000); and any problems with output images or with contamination within the apparatus main body 1 were at a fully permissible level.

As explained above, according to the present embodiment: a carrier C having a conductive covering layer comprising a tin dioxide layer and an indium oxide layer, and containing conductive particles with oil adsorbance formed in a specified range was used; a toner T having a bonding resin containing a hybrid resin was used; and further, the gap between the developing roller 23*a* and the photosensitive drum 21 was optimized. Extended operating life of the two-component developer was thereby achieved without the problems of toner scattering, etc, and without producing a large drop off of toner charge either in the initial period or over time.

In addition, in the present embodiment, the processing cartridges 20Y, 20M, 20C, and 20BK were respectively configured as single units with a photosensitive drum 21, a charge unit 22, and a cleaning unit 25. Moreover, developing units 23Y, 23M, 23C, and 23BK were configured as independent units. In contrast, the developing units 23Y, 23M, 23C, and 23BK can be unified with the process cartridges 20Y, 20M, 20C, and 20BK. Specifically, the process cartridge 20 can be configured by the photosensitive drum 21, the charge unit 22, the developing unit 23, and the cleaning unit 25. The same effect as that of the present embodiment is produced in this case as well.

As explained above, the present invention: uses a carrier C having a conductive covering layer comprising a tin dioxide layer and an indium oxide layer and containing conductive particles with oil adsorbance formed in a specified range; uses a toner T having a bonding resin containing a hybrid resin; and further, optimizes the gap between the developing roller 23*a* and the photosensitive drum 21. The present invention can thereby offer an image forming apparatus and process cartridge that achieves extended operating life of the two-component developer without producing such problems as toner scattering either in the initial period or over time.

Various modifications will become possible for those skilled in the art after receiving the teachings of the present disclosure without departing from the scope thereof.

What is claimed is:

1. An image forming apparatus comprising:

an image support member on which an electrostatic latent image is formed; and a developing unit that houses a two-component developer comprising a toner and a carrier, and comprises a developer support member that supports the two-component developer at a position opposing the image support member, wherein the gap between the image support member and the developer support member in the opposing position is 0.3±0.1 mm;

the carrier has a resin cover layer on the surface of a core material;

the resin cover layer comprises conductive particles provided with a conductive covering layer comprising a tin dioxide layer on the surface of base particles, and an indium oxide layer including tin dioxide provided on the tin dioxide layer;

the conductive particles are formed so that an oil adsorption thereof is 10 to 300 mL/100 g;

the toner is provided with a bonding resin, releasing agent, and coloring agent; and the bonding resin comprises a hybrid resin having a vinyl polymer and a polyester polymer, and is formed such that the amount of the hybrid resin contained in relation to the amount of the releasing agent is in the range of 0.5 to 3.

2. The image forming apparatus as claimed in claim 1, wherein a toner concentration of the two-component developer is controlled to be in the range of 6 to 12% by weight.

3. The image forming apparatus as claimed in claim 1, wherein the two-component developer is formed such that, when a toner concentration is controlled to be 10% or more by weight, a charge of the toner is in the range of 25 to 33 μC/g at room temperature and normal humidity.

4. The image forming apparatus as claimed in claim 1, wherein only a DC image bias is applied to the developer support member.

5. The image forming apparatus as claimed in claim 1, wherein the carrier is formed such that a weight average particle size thereof is in the range of 20 to 65 μm.

6. The image forming apparatus as claimed in claim 1, wherein the toner is formed such that an average particle size thereof is in the range of 3.5 to 7.5 μm.

7. A process cartridge which is provided to be freely attached to and detached from an apparatus main body of an image forming apparatus, and in which an image support member and a processing unit are unified, wherein an image forming apparatus comprises:

the image support member on which an electrostatic latent image is formed; and a developing unit that houses a two-component developer comprising a toner and a carrier, and comprises a developer support member that supports the two-component developer at a position opposing the image support member, and wherein the gap between the image support member and the developer support member in the opposing position is 0.3±0.1 mm;

the carrier has a resin cover layer on the surface of a core material;

the resin cover layer comprises conductive particles provided with a conductive covering layer comprising a tin dioxide layer on the surface of base particles, and an indium oxide layer including tin dioxide provided on the tin dioxide layer;

the conductive particles are formed so that an oil adsorption thereof is 10 to 300 mL/100 g;

the toner is provided with a bonding resin, releasing agent, and coloring agent; and the bonding resin comprises a hybrid resin having a vinyl polymer and a polyester polymer, and is formed such that the amount of the hybrid resin contained in relation to the amount of the releasing agent is in the range of 0.5 to 3.

* * * * *